US005944004A

United States Patent [19]

Goff et al.

[11] Patent Number: 5,944,004

[45] **Date of Patent: *Aug. 31, 1999**

[54] ARCHERY STABILIZER AND DRAWLOCK

[76] Inventors: Jerry Alan Goff; Sherwood Lunsford Goff, both of 21595 Yankee Town Rd., Saucier, Mich. 39574

[ * ] Notice: This patent is subject to a terminal disclaimer.

[21] Appl. No.: 08/939,295

[22] Filed: Sep. 29, 1997

Related U.S. Application Data

[63] Continuation-in-part of application No. 08/778,659, Jan. 3, 1997, Pat. No. 5,671,723.

[51] Int. Cl.[6] ..... F41B 5/18; F41B 5/20; F41B 5/22

[52] U.S. Cl. ..... 124/35.2; 124/44.5; 124/86; 124/89

[58] Field of Search ..... 124/23.1, 24.1, 124/25.6, 35.2, 44.5, 86, 88, 89

[56] References Cited

U.S. PATENT DOCUMENTS

| | | | |
|---|---|---|---|
| 1,210,332 | 12/1916 | Kvistad | 124/23.1 |
| 1,526,176 | 2/1925 | O'Connell | 124/35.2 X |
| 2,664,078 | 12/1953 | Irwin . | |
| 2,757,657 | 8/1956 | Lohmeyer . | |
| 2,815,016 | 12/1957 | Kellogg . | |
| 2,816,537 | 12/1957 | Irwin . | |
| 2,926,650 | 3/1960 | Irwin . | |
| 2,982,279 | 5/1961 | Pursley . | |
| 3,446,200 | 5/1969 | Gross . | |
| 4,027,645 | 6/1977 | Damron . | |
| 4,829,974 | 5/1989 | Anderson . | |
| 5,092,308 | 3/1992 | Sheffield | 124/25 |
| 5,140,972 | 8/1992 | Fisk | 124/44.5 |
| 5,156,138 | 10/1992 | Grover | 124/35.2 |
| 5,390,654 | 2/1995 | Perkins | 124/24.1 |
| 5,465,705 | 11/1995 | Baeseman | 124/88 |
| 5,671,723 | 9/1997 | Goff et al. | 124/35.2 |

*Primary Examiner*—John A. Ricci
*Attorney, Agent, or Firm*—Seidel, Gonda, Lavorgnia & Monaco, PC

[57] ABSTRACT

The invention comprises a combination stabilizer/drawlock device adapted for use with an overdraw arrow rest in archery and bowhunting. The stabilizer/drawlock device includes an elongated mounting bracket having near its forward end a bolt slot for attaching the bracket to an archery bow's handle, and having intermediate its forward and rearward ends a support for an overdraw arrow rest that permits the arrow rest to be positioned at a selectable distance to the rear of the bow's handle. The device further includes a draw tube attached to the rearward end of the mounting bracket and a draw rod in telescoping engagement with the draw tube. The draw tube can be attached to the bow at a selectable angle or permitted to pivot freely to align with the axis of the arrow between nock point and arrow rest after vertical adjustment to a tuned nocking point. The back end of the draw rod supports a bow string mechanical release. A latching device locks and holds the draw rod at a full draw position when the bow string is drawn beyond the full draw position. The drawlock latch may be removed and replaced by an interchangeable plate which acts as a stabilizer but which does not include the spring lever, pivot point and stop pin. This stabilizer plate may be used to accommodate state hunting and sport regulations which may not permit the use of a drawlock mechanism. In both plate configurations, the device uses the draw rod as a stabilizer.

15 Claims, 4 Drawing Sheets

ARCHERY STABILIZER AND DRAWLOCK

CROSS-REFERENCE TO RELATED APPLICATION

This application is a continuation-in-part of application Ser. No. 08/778,659, entitled "Archery Drawlock", filed Jan. 3, 1997, now U.S. Pat. No. 5,671,723.

FIELD OF THE INVENTION

The invention relates to the general field of archery bow accessories, and to the more specific field of devices which stabilize the bow.

BACKGROUND OF THE INVENTION

A conventional bow stabilizer's primary purpose is to minimize handle torque and vibration at release. Stabilization is particularly important to reduce the horizontal inaccuracy problems caused by an overdraw rest and shorter, light-weight arrows, where canting of even a few degrees has the tendency to move arrow impact away from the sight alignment. Vibration produced noise is another problem which can be reduced by bow stabilization.

Bow stabilizers reduce torque and vibration by placing counterweight to the torque away from the handle. Traditional bow stabilizers have been in use by archers and bowhunters for many years, and are primarily in the form of a weighted bob at the end of a rod. More recently, several multi-purpose stabilizers have been introduced, incorporating flashlight attachments, storage compartments, trailing lines, and other accessories.

The present invention is directed to a multi-purpose stabilizer in the form of a draw rod with a mechanical release. Draw rods are used in conjunction with a latching mechanism to lock the bow at a drawn position, forming a drawlock. However, a draw rod, used alone, is very effective in stabilizing a bow. The front-hand to back-hand bridge provided by the rod is maintained after string release, essentially eliminating handle torque and locking in the sight alignment until the arrow has passed contact with the rest. It is an object of the invention to utilize this stabilizing effect of the drawrod.

Drawlocks of various types have been used by archers and bowhunters for many years, including the locking mechanisms on centuries-old crossbows. For upright bows a drawlock has generally been either a fixed rod along which the bow string is drawn or a moveable rod drawn along with the bow string. Both types use some sort of latch mechanism to lock the string at full draw, and a release mechanism to release the string and propel the arrow. (The term "full-draw" is used herein to mean the aimed draw position for a bow properly matched to the archer, rather than an absolute maximum draw.) A representative example of the fixed rod type is disclosed in U.S. Pat. No. 2,926,650; a representative example of the moveable rod type is disclosed in U.S. Pat. No. 2,982,279.

The modern upright bow design has evolved from long bow through recurve and compound bows of numerous varieties, and the range and variety of arrow rests, bow sights, stabilizers, mechanical releases, and other accessories has likewise proliferated. While some earlier forms of drawlocks may be usable with modern bows and accessories, it is an objective of this invention to provide a combination stabilizer and drawlock kit (hereinafter "stabilizer/drawlock device") for the contemporary design of a compound bow, particularly a bow equipped with an overdraw arrow rest which permits the use of shorter, lighter arrows to increase velocity and flatten arrow trajectory. It is another objective of this invention to provide for an overdraw rest and shelf to be mounted on the stabilizer/drawlock device at a selectable overdraw distance.

The type of compound bow for which this draw rod stabilizer is designed has a handle portion with a sight window above the grip that is cut past the center of the handle to allow fletching clearance and allow sideways arrow rest adjustment. This sight window and the hand configuration of the grip make the bow either "right handed" or "left handed". It is an objective of this invention to make a universal draw rod stabilizer/drawlock which can be mounted on either a right or left handed compound bow.

Modern compound bows of this type usually have a threaded hole drilled and tapped through the handle directly above the grip to receive an arrow rest. The bow manufacturer usually locates the hole precisely at the "pivot-point" area of the handle, which moves less than any other part of the handle as the bow torques and vibrates during a shot. It is an objective of this invention to use this pre-drilled arrow rest hole to attach the stabilizer/drawlock device to the handle.

With the arrow rest hole used to support the stabilizer/drawlock device, the overdraw rest must be supported elsewhere. It is an objective of this invention to allow the mounting of an overdraw arrow rest and an overdraw shelf on the stabilizer/drawlock device at a selectable rearward position from approximately one to five inches behind the grip.

With the overdraw arrow rest located well behind the "pivot point", the negative effect on accuracy of minor release or tuning errors is increased. For this reason, most archers using an overdraw will find that they shoot better with a mechanical string release than with a finger release. For the same reason, in tuning the bow the nocking point on the string must be carefully adjusted to eliminate up-and-down wobble of the arrow in flight, and the arrow rest carefully adjusted horizontally to eliminate side-to-side wobble. It is an objective of this invention to provide a stabilizer/drawlock device in which the draw rod is alignable with the tuned locations of nock point and arrow rest.

It is a further objective of the invention to provide a bow stabilizer/drawlock kit which has two interchangeable plates on which the draw tube is attached. One plate contains a latching mechanism; the other plate is without any latching mechanism. The plates may be interchanged depending on whether the archer or bowhunter prefers or is required by hunting regulations to hold his draw manually or, alternatively, to use the plate containing the latching device to lock and hold the draw rod at a full draw position. These interchangeable stabilizer and drawlock plates may be sold separately as a conversion device or together with the other draw rod stabilizer as a kit.

It is another objective of the invention in its drawlock configuration to provide a superior and more positive latching of the drawlock rod at full draw.

Further advantages of the invention may be appreciated by reading the following descriptions.

SUMMARY OF THE INVENTION

The invention comprises a multi-function bow stabilizer in the form of a draw rod device. The stabilizer includes an elongated mounting bracket having near its forward end a bolt slot for attaching the bracket to an archery bow's handle. Positioned between its forward and rearward ends is an elongated slot for mounting an overdraw arrow rest at a selectable distance to the rear of the bow's handle. The device further includes the draw tube. The draw tube is mounted on a plate attached to the bow at a selectable angle to align with the axis of the arrow between nock point and arrow rest after vertical adjustment to a tuned nocking point.

A second aspect of the invention is a kit for a draw rod bow stabilizer which is convertible to a drawlock. The kit includes two interchangeable plates having a draw tube. One plate has a drawlock latch. The other plate has no drawlock latch and only acts as a bow stabilizer. Either plate can be mounted onto the bow at a given time, depending on the archer's particular hunting or sport requirements.

BRIEF DESCRIPTION OF THE DRAWINGS

The drawings show a form of the invention which is presently preferred; however, the invention is not limited to the precise arrangement shown in the drawings.

DETAILED DESCRIPTION OF THE DRAWINGS

Figure 1:
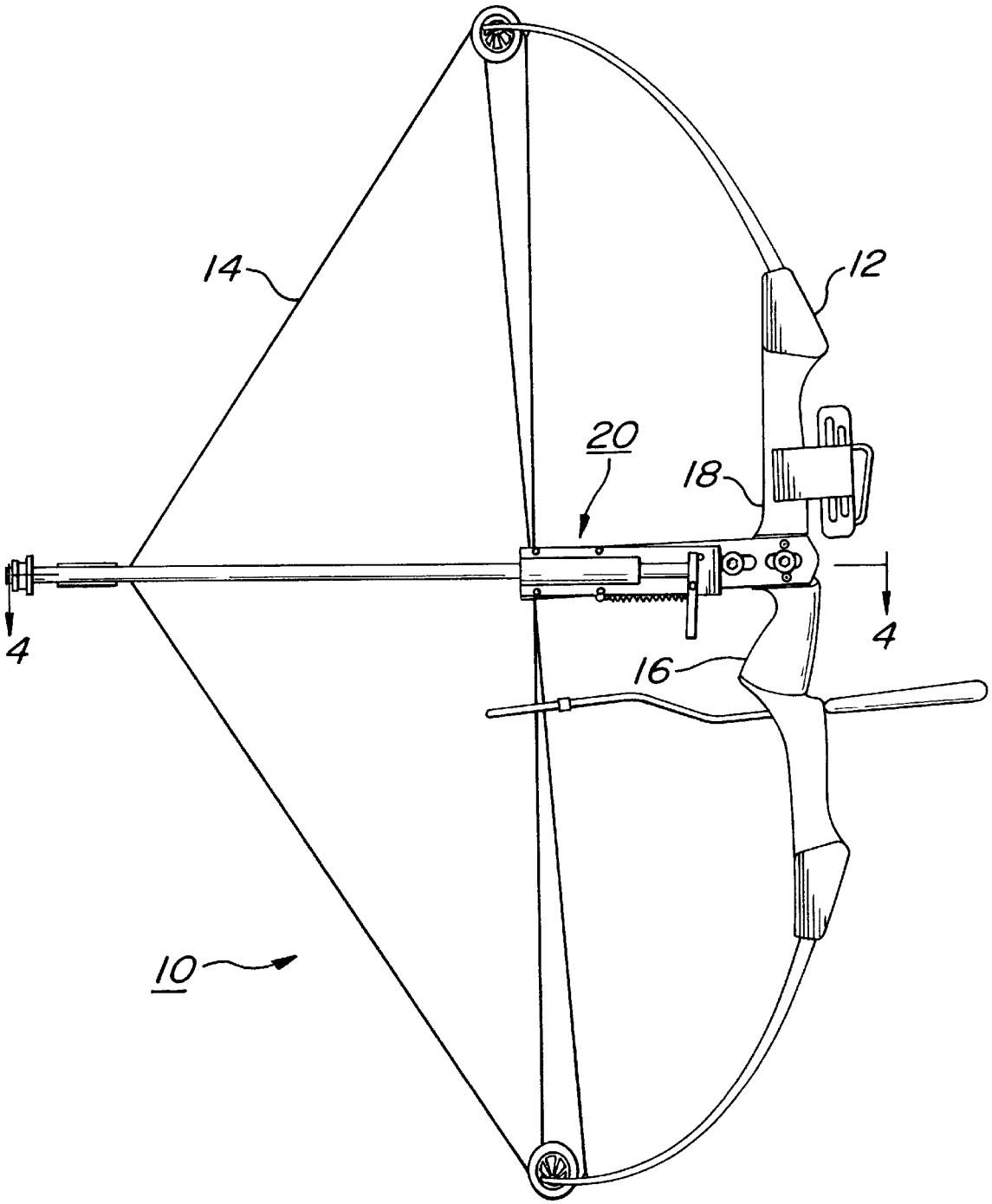
FIG. 1 is a side view of a compound bow on which a stabilizer/drawlock device, depicting the invention in its drawlock configuration, is attached for a right-handed archer, and is shown in the drawn and locked position.

FIG. 1 shows a generic compound bow (10) having a handle (12), upper and lower limbs each having an eccentric wheel, a bowstring (14), a cable guard, a conventional stabilizer, and a bow sight (the un-numbered elements are easily identified and not significant to a description of the invention). The handle is designed for a "right-handed" archer; that is, an archer who grips the handle with his left hand and draws the bow with his right hand. Consequently, the handle has a grip (16) conforming ergonomically to a left hand grasp. Directly above the grip on the palm side is a sight window (18). The sight window is a "center-shot" configuration, in that the sight window is cut past the vertical centerline of the handle to allow clearance for the arrow fletching and sideways arrow rest adjustment. In this bow's normal configuration, an arrow rest would be attached in the sight window. However, in the configuration depicted and described herein, the bow will be equipped with an "overdraw" arrow rest.

The invention is shown in FIG. 1 in the configuration of an archery drawlock device (20) adapted for use with an overdraw arrow rest.

Figure 2:
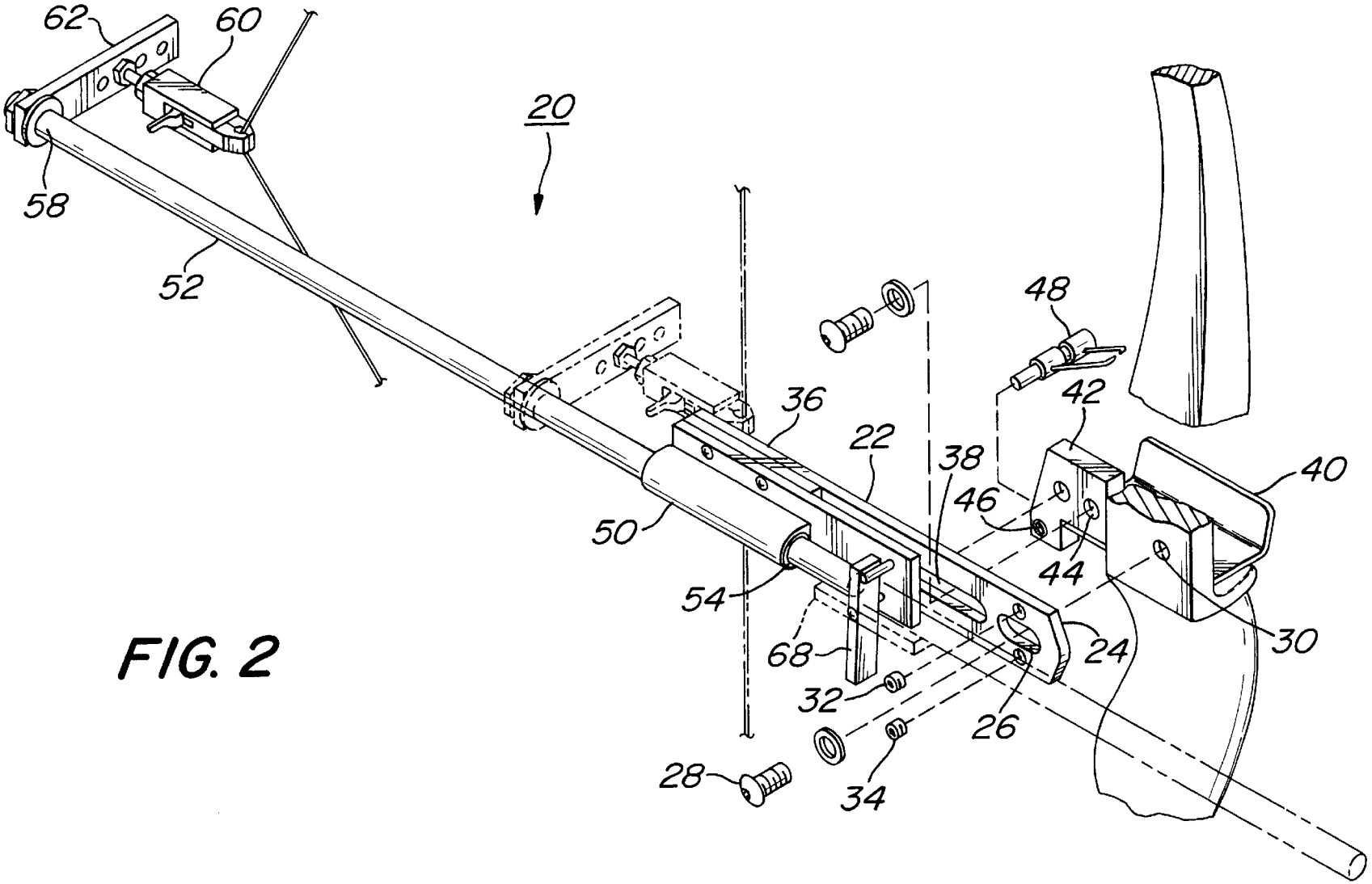
FIG. 2 is a perspective view of the stabilizer/drawlock device of FIG. 1, exploded from the bow, and shown by ghost lines in an undrawn position.
Figure 4:
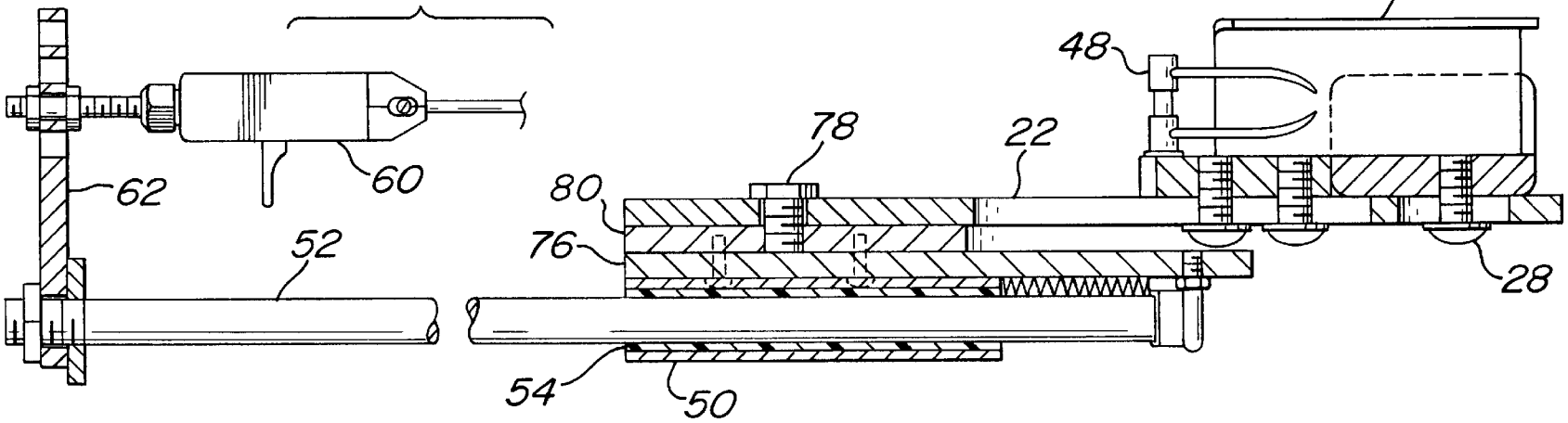
FIG. 4 is a top view of portions of the stabilizer/drawlock of FIG. 1.

As shown in FIGS. 2 and 4, the drawlock device (20) includes an elongated mounting bracket (22). At the forward end (24) of the bracket (22) is the means by which the bracket is attached to the handle of the bow. An aperture (26) through the forward end of the bracket allows the shaft of a threaded bolt (28) to be screwed into a pre-drilled and taped arrow rest hole (30) in the handle, with the head of the bolt (28) tightened down against the mounting bracket (a washer may be inserted between bolt head and bracket). Set screws (32, 34) are located above and below the aperture (26) and are tightened against the handle to lock the bracket in a position generally perpendicular to the handle. In the preferred embodiment depicted, the aperture (26) is a short slot aligned with the long axis of the bracket (22), as depicted in the drawings. The slot-aperture (26) allows the bracket to be adjusted slightly fore or aft of the pre-drilled arrow rest hole (30) before tightening the bolt (28), so that the set screws can be positioned against a flat surface of the handle. Otherwise, the aperture (26) could be merely a round hole of proper diameter.

Behind the aperture (26), and situated between the forward end (24) and the rearward end (36) of the mounting bracket is the means by which an overdraw arrow rest can be supported at a selectable position to the rear of the bow's handle. An elongated slot (38), having a longitudinal axis generally aligned along the long axis of the mounting bracket (22), is adapted to receive a bolt coupling an overdraw shelf and arrow rest to the bracket. In the embodiment depicted, the overdraw shelf (40) is attached to a mounting plate (42) which has one or two bolt holes (44) and a threaded port (46) for the attachment of a variety of arrow rests. The arrow rest (48) depicted is a launcher-style rest with a two-prong arrow support, but other types of rest can be used. The concept of the overdraw rest is that the arrow is supported behind the grip, enabling full draw with a shorter, lighter arrow. The length of the elongated slot (38) permits this overdraw distance to adjusted between approximately one to five inches behind the grip. The overdraw arrow rest and shorter arrow shaft place the hunting broadhead behind the bow hand and wrist at full draw. The overdraw shelf provides a guard for the hand and wrist if the arrow jumps the rest at or before string release.

The drawlock device (20) further includes a draw tube (50) attached to the mounting bracket (22) near the rearward end (36) of the bracket. The tube (50) is intended to allow telescoping movement of a draw rod (52). The draw tube is preferably a metal exterior tube lined with a soft bushing (54) of material such as PVC or other plastic composition to eliminate the noise that would be produced by metal-to-metal contact with the draw rod. The draw rod (52) has a blunt end (56) for insertion through the draw tube and a second, opposite end (58) which supports a bow string mechanical release (60). The preferred type release is the style known as a "caliper" release with a free-swiveling head and a trigger. Since the draw lock system permits the bow to be carried in a full draw position, a preferred release also has a trigger safety (not depicted) of some type, such as a safety similar to the cross-bar safety in the trigger guard of many rifles and shotguns.

A spacer bar (62) is used to space the release a proper distance from the draw bar. One end of the spacer bar is attached to the opposite end (58) of the draw rod. The spacer bar has several attachment holes to attach the release at a selectable distance from the draw bar, depending upon the thickness of the grip and location of the eccentric cable tracks (the string on a compound bow should be aligned with the cable track of the eccentric wheels). The spacer bar (62) further serves as a finger grip to draw the string.

In this drawlock configuration, the stabilizer/drawlock device (20) further includes a latching means for locking and holding the draw rod at a full-draw position. The latching means includes a pivot pin (64) located on the mounting bracket (22) on one side of the elongated slot (38), and a stop pin (66) located on the opposite side of the slot (38), generally directly across the slot from the pivot pin. A latch bar (68) is rotatably mounted on the pivot pin (64) at a position intermediate the ends of the bar (68). The length of the bar from a first end (70) to the pivot pin (64) is greater than the distance between the pivot pin (64) and the stop pin (66). A spring (72) is attached to the latch bar between the pivot pin and the opposite, second end (74) of the bar, and the other end of the spring is attached to the mounting bracket to the rear of the pivot pin (66). The spring is biased to pivot the first end of the bar toward the stop pin. When the draw rod is in the undrawn position shown by ghost lines in FIGS. 2 and 3, the latch bar lies along the rod with the spring tensioned. When the string is drawn past full-draw position, the draw rod moves past the first end of the latch bar, and the spring causes the bar to pivot across the slot (38) until the bar strikes the stop pin (66). The draw can then be relaxed slightly to bring the blunt end of the rod into contact against the bar. The pressure of the drawn string will the hold the rod firmly against the bar, effectively locking the bow in a full draw position. This latching means achieves the objective of providing a superior and more positive latching of the drawlock rod at full draw than found in prior drawlocks.

Figure 3:
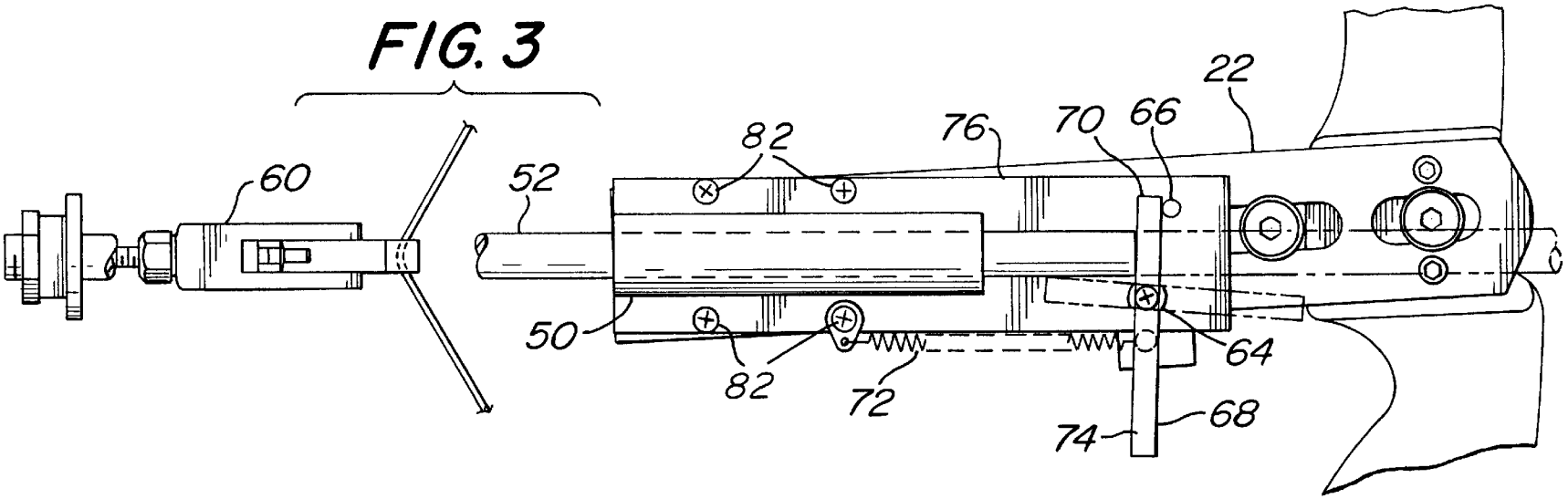
FIG. 3 is a side view of portions of the stabilizer/drawlock device of FIG. 1, showing the mechanical string release and the draw rod latching mechanism in greater detail.

As shown in FIG. 3, in the drawlock configuration the draw tube (50), pivot pin (64), stop pin (66) and spring (72) are mounted on a mounting plate (76) which can be attached to the mounting bracket (22) at a selectable angle, or permitted to pivot freely, such as by a bolt (78). This allows the axis of the tube to be aligned with the axis of the arrow from nock point to rest, which may be at an angle slightly above or below the axis of the mounting bracket, depending upon the tuning needed to eliminate vertical wobble of the arrow in flight. By aligning the draw tube with the arrow, the draw rod is centered in the tube during the draw, eliminating any additional draw weight which would be caused by friction between tube and rod in an off-center alignment. However, even with this selectable angle plate, the stop pin is still on the opposite side of the slot from the pivot pin and still generally directly across the slot from the pivot pin.

Figure 5:
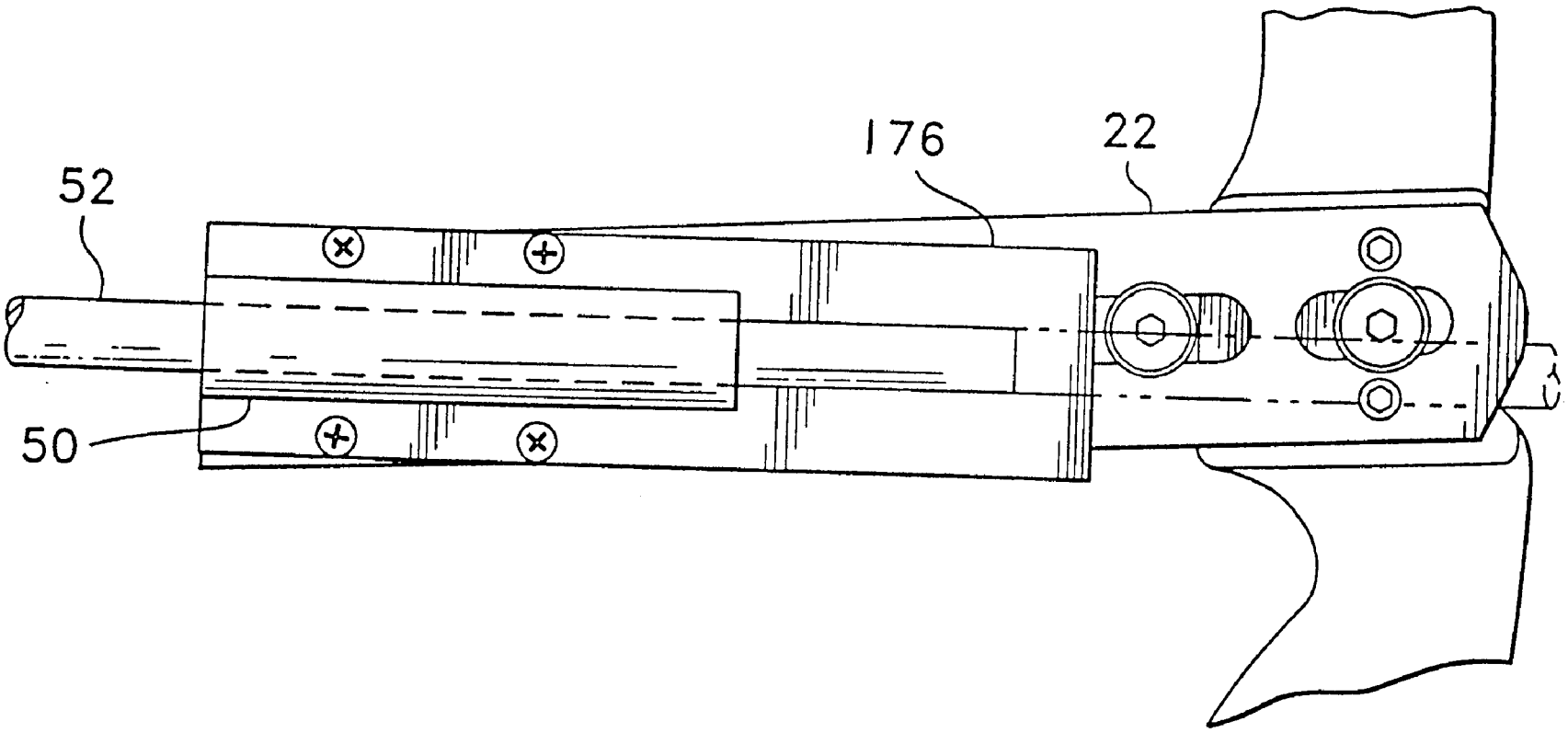
FIG. 5 is a side view of the stabilizer/drawlock device, depicting the stabilizer configuration of the invention, in which the interchageable draw tube mounting plate without a latching mechanism is shown.

FIG. 5 shows an alternate configuration in which the device is a draw tube stabilizer without a latching mechanism. The plate (76) of the previous drawlock configuration is replaced by an alternate plate (176), which is interchangeable with and virtually identical to the other plate (76) except that it does not have the locking mechanism. The manner of interchangeability of the plates (76, 176) can be best seen by reference to FIGS. 3 and 4. A short bracket (80) is sandwiched between the mounting bracket (22) and either plate (76, 176). The plates are interchangeable by being removably attached to the short bracket (80) by screws (82).

The stabilizer (20) can thus be used in drawlock form by attaching the plate (76) bearing the spring lever (72), pivot pin (64) and stop pin (66). Alternatively, the interchangeable plate (76) containing the locking mechanism may be removed and replaced by the other interchangeable plate (176) to make the device act only as a stabilizer. The combination stabilizer/drawlock may be sold together as a dual-plate kit. Alternatively, the non-latching plate may also be offered separately to accommodate state hunting regulations.

Although the stabilizer/drawlock device is described herein as it is mounted on a right-handed bow, the device is just as adeptly mounted on a left-hand bow. The mounting bracket merely inverts top to bottom when it is mounted on a left-hand bow, with the only asymmetry being that the pivot pin and spring are now above the slot (38) instead of below it. However, the spring will still pull the latch bar across the slot and into the stop pin in exactly the same manner when the draw rod is retracted beyond full draw.

Whether the device is used in the drawlock configuration or the non-drawlock configuration, the release hand remains on the draw bar after string release, countering hand torque and minimizing vibration.

This invention may be embodied in other specific forms without departing from its spirit or essential attributes. Accordingly, reference should be made to the following claims, rather than to the foregoing description, to determine the full scope of the invention.

What is claimed is:

1. An archery bow stabilizer, comprising:

(a) an elongated mounting bracket having a forward end and a rearward end;

(b) the mounting bracket having near its forward end a means for attaching the bracket to an archery bow's handle;

(c) a plate attachable to the mounting bracket, the plate having a draw tube mounted on it to be aligned with a drawn arrow for vertical tuning; and (d) a draw rod having a first end for insertion through the draw tube and a second end supporting a bow string mechanical release.

2. An archery bow stabilizer as in claim 1, further comprising the mounting bracket having intermediate to its forward and rearward ends a means for supporting an overdraw arrow rest at a selectable distance to the rear of the bow's handle.

3. An archery bow stabilizer as in claim 2, further comprising an elongated slot having a longitudinal axis generally aligned along the longitudinal axis of the mounting bracket to receive a bolt coupling an overdraw shelf and rest to the bracket at a selectable distance.

4. An archery bow stabilizer as in claim 1, wherein the means for attaching the mounting bracket to the bow's handle includes an aperture for passing the shaft of a bolt therethrough, said bolt being adapted to thread into a threaded hole in the archery bow's handle.

5. An archery bow stabilizer as in claim 4, wherein the aperture is a short slot having its longitudinal axis generally aligned along the longitudinal axis of the mounting bracket.

6. An archery bow stabilizer as in claim 5, wherein the threaded hole in the archery bow's handle is pre-drilled and tapped to locate an arrow rest over a grip portion of the handle.

7. An archery bow stabilizer as in claim 1, further comprising a spacer bar attached at one end thereof to the second end of the draw rod, the spacer bar adapted to receive the bowstring mechanical release at various separation distances from the draw rod.

8. An archery bow stabilizer as in claim 1, wherein the plate is attachable to the mounting bracket at a selectable angle to permit the draw tube mounted on the plate to be aligned with a drawn arrow for vertical tuning.

9. An archery bow stabilizer adapted for use on either a right handed or left handed bow, comprising:

(a) an elongated mounting bracket having a forward end and a rearward end;

(b) the mounting bracket having near its forward end a means for attaching the bracket to an archery bow's handle;

(c) a plate attachable to the mounting bracket and having a draw tube mounted on the plate;

(d) a draw rod having a first end for insertion through the mounting tube and a second end supporting a bow string mechanical release.

10. An archery bow stabilizer as in claim 9, wherein the plate is attachable to the mounting bracket at a selectable angle to permit the draw tube mounted on the plate to be aligned with a drawn arrow for vertical tuning.

11. An archery bow stabilizer as in claim 9, wherein the plate is attachable to the mounting bracket in a pivotable manner to permit the draw tube mounted on the plate to be aligned with a drawn arrow for vertical tuning.

12. A kit for an archery bow stabilizer convertible to a drawlock, comprising:

(a) an elongated mounting bracket having a forward end and a rearward end;

(b) the mounting bracket having near its forward end a means for attaching the bracket to an archery bow's handle;

(c) a draw rod having a first end for insertion through a draw tube and a second end supporting a bow string mechanical release, (d) a first plate attachable to the mounting bracket at a selectable angle to permit a draw tube mounted on the plate to be aligned with a drawn arrow for vertical tuning, (e) a second plate interchangeable with the first plate and attachable to the mounting bracket at a selectable angle to permit a draw tube mounted on the plate to be aligned with a drawn arrow for vertical tuning, the second plate further having a latching device for locking and holding the draw rod at full draw position when the bow string is drawn beyond the full draw position.

13. A kit as in claim 12, wherein the latching device of the drawlock plate comprises:

(a) a pivot pin attached to the second plate between the draw tube and the front end of the second, and located to one lateral side of the draw tube;

(b) a stop pin attached to the second plate between the draw tube and the front end of the second plate, and located to the opposite lateral side of the draw tube and generally directly lateral across the bracket from the pivot pin;

(c) a bar rotatably mounted on the pivot pin at a position intermediate the ends of the bar, the bar having a length such that the distance from a first end of the bar to the pivot pin is greater than the distance between the pivot pin and the stop pin, and (d) a spring means attached to the bar between the second end of the bar and the pivot pin and biased to pivot the first end of the bar toward the stop pin.

14. A kit for an archery bow stabilizer convertible to a drawlock, comprising:

(a) an elongated mounting bracket having a forward end and a rearward end;

(b) the mounting bracket having near its forward end a means for attaching the bracket to an archery bow's handle;

(c) a draw rod having a first end for insertion through a draw tube and a second end supporting a bow string mechanical release, (d) a first plate attachable to the mounting bracket in a pivotable manner to permit a draw tube mounted on the plate to be aligned with a drawn arrow for vertical tuning, (e) a second plate interchangeable with the first plate and attachable to the mounting bracket in a pivotable manner to permit a draw tube mounted on the plate to be aligned with a drawn arrow for vertical tuning, the second plate further having a latching device for locking and holding the draw rod at full draw position when the bow string is drawn beyond the full draw position.

15. A kit as in claim 14, wherein the latching device of the drawlock plate comprises:

(a) a pivot pin attached to the second plate between the draw tube and the front end of the second, and located to one lateral side of the draw tube;

(b) a stop pin attached to the second plate between the draw tube and the front end of the second plate, and located to the opposite lateral side of the draw tube and generally directly lateral across the bracket from the pivot pin;

(c) a bar rotatably mounted on the pivot pin at a position intermediate the ends of the bar, the bar having a length such that the distance from a first end of the bar to the pivot pin is greater than the distance between the pivot pin and the stop pin, and (d) a spring means attached to the bar between the second end of the bar and the pivot pin and biased to pivot the first end of the bar toward the stop pin.

* * * * *